US007691040B1

(12) United States Patent
Schwinghamer

(10) Patent No.: US 7,691,040 B1
(45) Date of Patent: Apr. 6, 2010

(54) UNIVERSAL GRIP-HANDLE FOR EXERCISE EQUIPMENT

(76) Inventor: Paul A. Schwinghamer, 11417 Missouri Ave., Unit 3, Los Angeles, CA (US) 90025

( * ) Notice: Subject to any disclaimer, the term of this patent is extended or adjusted under 35 U.S.C. 154(b) by 1082 days.

(21) Appl. No.: 11/273,999

(22) Filed: Nov. 14, 2005

(51) Int. Cl.
*A63B 71/00* (2006.01)

(52) U.S. Cl. ..... 482/139; 482/49; 482/50; 482/106

(58) Field of Classification Search ..... 482/80–82, 482/126, 121, 139, 99–103, 132, 49, 50, 482/106; D21/694
See application file for complete search history.

(56) References Cited

U.S. PATENT DOCUMENTS

| | | | | |
|---|---|---|---|---|
| 4,109,907 | A * | 8/1978 | Zito | 482/94 |
| 4,205,839 | A | 6/1980 | Best | |
| 4,725,057 | A | 2/1988 | Shifferaw | |
| 4,880,230 | A | 11/1989 | Cook | |
| 5,090,691 | A | 2/1992 | Pollock | |
| 5,407,405 | A | 4/1995 | Oren | |
| 5,505,677 | A | 4/1996 | Hinds | |
| 5,533,952 | A | 7/1996 | Schaber | |
| 5,549,532 | A | 8/1996 | Kropp | |
| 5,556,369 | A * | 9/1996 | Roberts | 482/131 |
| 5,571,064 | A * | 11/1996 | Holm | 482/129 |
| 5,820,529 | A * | 10/1998 | Weintraub | 482/92 |
| 5,967,955 | A | 10/1999 | Westfall et al. | |
| 6,267,711 | B1 | 7/2001 | Hinds | |
| 6,319,179 | B1 | 11/2001 | Hinds | |
| 6,551,222 | B1 * | 4/2003 | Beaver | 482/82 |
| 6,652,420 | B2 | 11/2003 | Chen | |
| 6,672,997 | B1 * | 1/2004 | Winkler | 482/126 |
| 7,300,388 | B2 * | 11/2007 | Sams, III | 482/89 |

* cited by examiner

*Primary Examiner*—Glenn Richman
(74) *Attorney, Agent, or Firm*—Elliott N. Kramsky

(57) ABSTRACT

A grip-handle for coupling to a resistance force provided by exercise equipment. The handle includes a hollow, generally-cylindrical hand hold. A flexion cable is fixed to opposed ends of a central shaft that is coaxial with the hand hold with a pulley guide member having a hook for engaging the equipment cable located therebetween. Generally-planar, circular side members having notched peripheries are fixed to the ends of the hand hold. The diameters of the side members exceed that of the hand hold to maintain the cable in position and removed from the hand of a user during the full range of wrist motion provided by the grip-handle during exercise.

20 Claims, 4 Drawing Sheets

FIG. 1
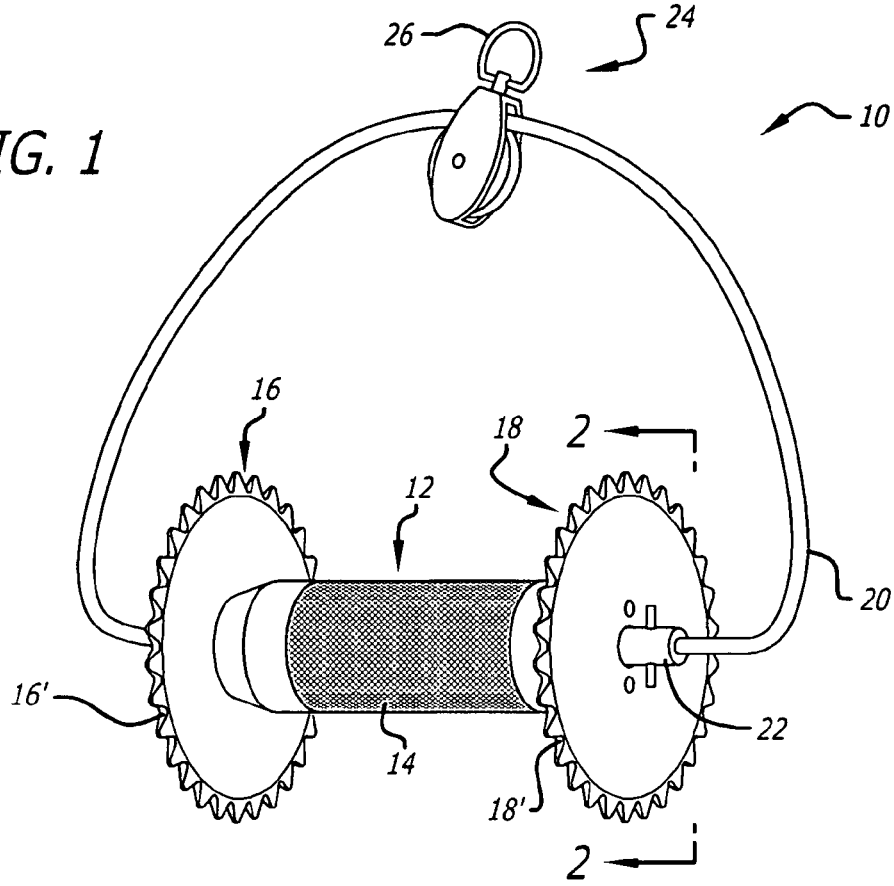
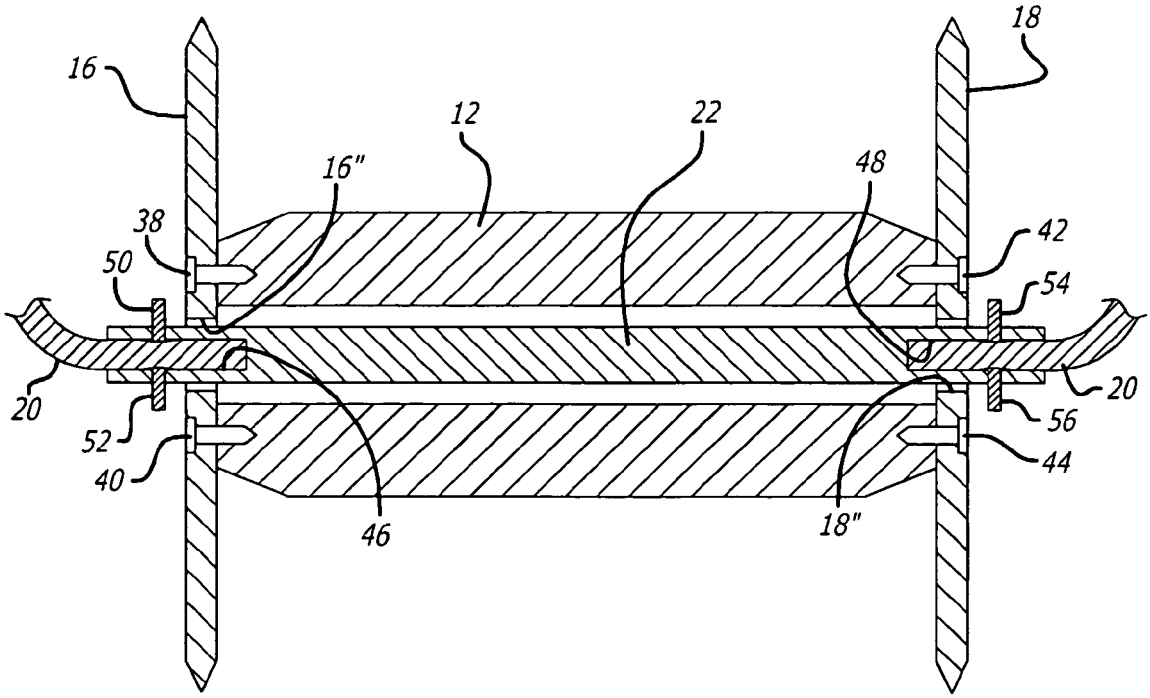
FIG. 2

UNIVERSAL GRIP-HANDLE FOR EXERCISE EQUIPMENT

BACKGROUND

1. Field of the Invention

The present invention relates to exercise equipment. More particularly, this invention pertains to a grip-handle for coupling to exercise equipment of the dynamic resistance type.

2. Description of the Prior Art

The health advantages of regular and rigorous exercise have led to the advent of numerous machines which offer advantages over free weight-based systems. Such machines may be based, inter alia, on elastomer, rubber band or tubing, pneumatic, spring coil and pulley system-based resistance forces. Examples include the cable and pulley-based devices taught by U.S. Pat. No. 4,725,057 of Shifferaw for "Universal Exercising Machine" (marketed under the trademark "BOWFLEX") and that of U.S. Pat. No. 5,967,955 of Westfall et al. for "Collapsible Exercise Device" (marketed under the trademark "TOTAL GYM").

Such equipment typically requires the user to grasp a grip-handle that attaches or clips to a direct (generally the case for elastomer, pneumatic and spring-based systems) or indirect resistance member (generally the case for cable and pulley-based systems) that provides measured resistance to the user's muscular contractions. Generally, such equipment includes a "standard" grip-handle of the type that allows simple wrist flexion and extension, but limits shoulder flexion, extension, abduction and adduction when the wrist attempts to deviate in a radial or ulnar direction in relation to the resistive force. Although the wrist is a complex joint capable of a wide range of motion, conventional grips do not routinely permit proper alignment of the joint with respect to a resistance force so that the user's musculature can gain the benefits that are otherwise made possible by the wrist's total motion capacity and the attendant possibilities for alignment and orientation of the body with respect to the resistance force transmitted through a cable or like device. Most commercially available handles for coupling to a cable that transmits a resistance force effectively limit wrist motion during exercise to flexion and extension from a supinated or pronated wrist starting position or wrist radial deviation and ulnar deviation from a semi-supinated wrist starting position.

SUMMARY OF THE INVENTION

The foregoing and other shortcomings of the prior art are addressed by the present invention which provides, in a first aspect, a grip-handle for exercise equipment of the type that provides a resistance force. Such grip-handle includes a generally-cylindrical hand hold having opposed ends. Side members are fixed to the opposed ends of the hand hold.

Opposed ends of a flexion cable are coupled to respective ends of the hand hold. A pulley is located intermediate the ends of the flexion cable. A hook is fixed to the pulley for coupling the grip-handle to the resistance force.

In a second aspect, a grip-handle in accordance with the invention includes an elongated central shaft having opposed ends. A generally-cylindrical hand hold surrounds and is coaxial with the shaft.

The opposed ends of a flexion cable are fixed to respective ends of the shaft. A pulley guide member is located intermediate the ends of the flexion cable. A hook is fixed to the pulley guide member for engaging a resistance cable.

The foregoing and additional features of the invention will become further apparent from the detailed description that follows. Such description is accompanied by a set of drawing figures. Numerals of the drawing figures, corresponding to those of the written description, point to the features of the invention. Like numerals refer to like features throughout both the written description and the drawing figures.

BRIEF DESCRIPTION OF THE DRAWINGS

FIG. 1 is a perspective view of the grip-handle of the invention;

FIG. 2 is a side sectional view of the grip-handle of the invention taken at section line 2-2 of FIG. 1.

DETAILED DESCRIPTION OF THE PREFERRED EMBODIMENT

Figure 3A:
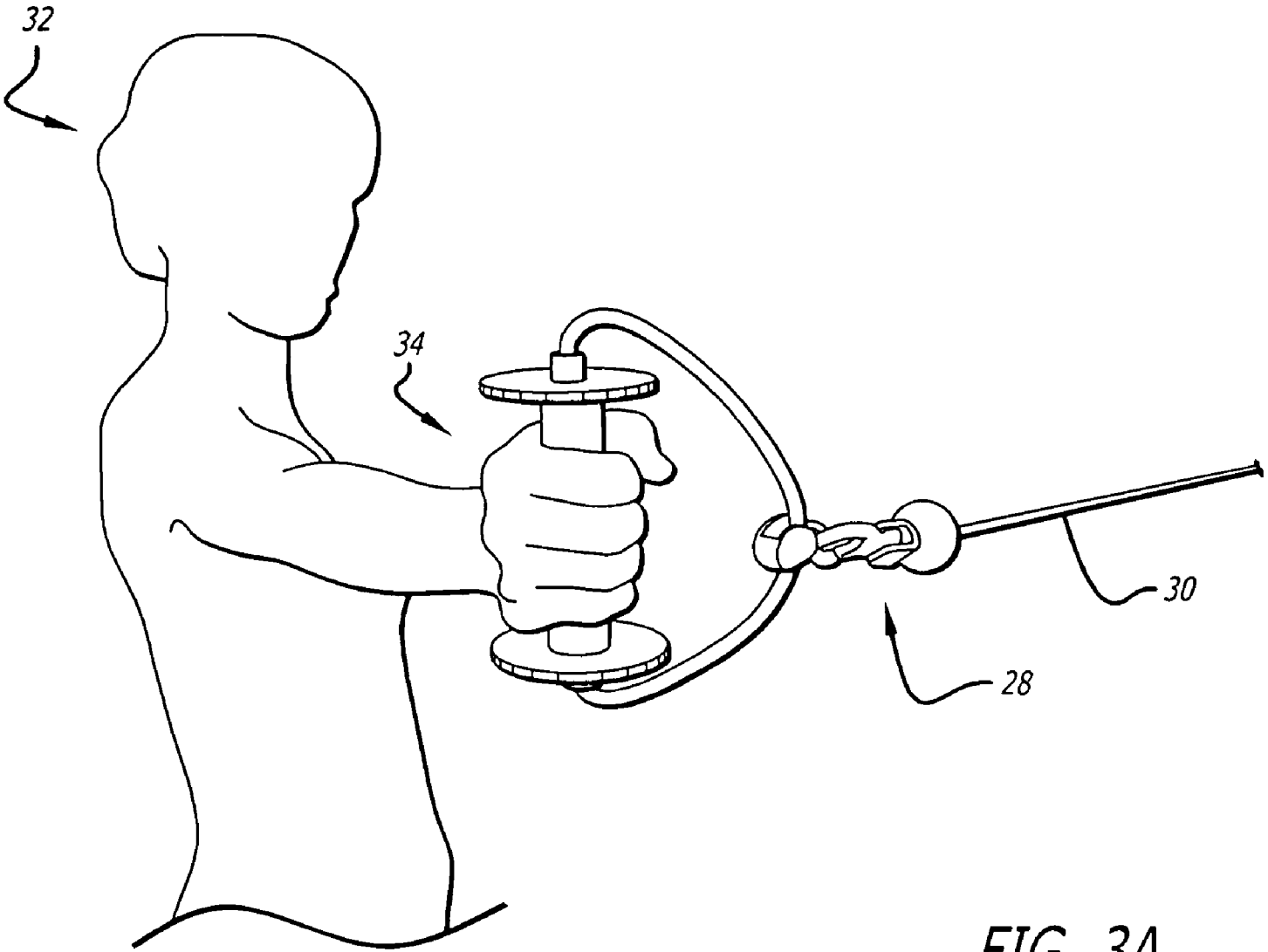
FIGS. 3A through 3C are a series of a perspective views of the handle of the invention in use, each view illustrating a different orientation of the grip-handle in use for exercising a different portion of a user's musculature.

FIG. 1 is a perspective view of the grip-handle 10 of the invention. The handle 10 provides a means for utilizing standard or conventional exercise equipment of the type that presents either a direct or indirect resistance force. Such force is engaged by coupling the grip-handle 10 to the force. While the grip-handle 10 may be coupled to the resistance forces generated by machines of the pneumatic, rubber band, rubber tubing, steel spring or cable and pulley types, it is illustrated below with reference to equipment of the cable and pulley-based type. Such equipment includes a cable, terminating in a clip. The cable is in communication with a source of resistance and the clip is provided for replaceably affixing one of a number of user handles. Such handles may be rigid or flexible, as in the case of a rope. The present invention offers the advantages of both rigid and flexible handles, thereby allowing a user to progress through a sequence of exercises, each stressing a different muscle or a different portion of a muscle, without a requirement of handle replacement. Such near-continual replacement of handles can be both tedious and time consuming as it requires the user to search around the workout area for a proper handle in the middle of exercising with a particular piece of equipment. This can make the equipment unavailable to others for extended periods of time while causing the user to "cool down" involuntarily and at inauspicious times during his (or her) workout. Such interruptions are particularly inefficient during physical therapy rehabilitation exercises that require very specific and graduated movements under sustained resistance force.

The grip-handle 10 includes a hand hold 12 which includes an abraded central region 14 for facilitating manual grasping. Generally-planar side members 16, 18 are fixed to opposed ends of the generally-cylindrical hand hold 12. The side members 16, 18 are preferably circular with pluralities of peripheral notches 16', 18' respectively.

Opposed ends of a flexion cable 20 are fixed to the ends of an elongated central shaft 22. The flexion cable 20 is preferably of braided metallic composition with a smooth covering of plastic or elastomeric material. It is received, intermediate its opposed ends, in a pulley guide 24 that includes a rotatable hook 26. Such hook 26 is provided for coupling to a clip 28 of conventional design of the type that is commonly provided at the end of a resistance cable 30 as illustrated in each of FIGS. 3A through 3C, a series of a perspective views of the grip-handle 10 of the invention in use, each view illustrating a different orientation of the grip-handle 10 in use for exercising a different portion of a user's musculature. As discussed above, numerous models and types of exercise equipment provide platforms that feature loads, perhaps of variable magnitude (for example, by means of selective engagement of a plate-like stack of individual weights).

It will be appreciated that the pulley guide 24 permits sliding of the flexion cable 20 with respect to the resistance cable 30 to which the grip-handle 10 of the invention has been attached in use. Referring again to FIGS. 3A through 3C, one may observe that a user 32 is thereby enabled to effectively rotate and freely move ("twist") the orientation of his or her hand and wrist 34 to achieve various exercise benefits without changing handles. For example, in FIGS. 3A and 3B, the user 32 employs the handle 10 to simulate a "standard" grip-handle connected via the cable attachment 28 to the resistance cable 30. The range of motion effected for the exercise in FIG. 3A involves a combination of the wrist in a semi-supinated position relative to the forearm, with the elbow extended and the shoulder abducted and moving through horizontal abduction away from midline. The range of motion effected for the exercise in FIG. 3B involves a combination of the wrist in a pronated position relative to the forearm, with the elbow extended and the shoulder moving through extension, downward and back toward the body. A unique aspect of the invention is shown in FIG. 3C where the user employs the same grip-handle 10 in one motion to simulate a "rope" type of grip-handle to oppose the resistive force transmitted through the cable 30. The range of motion effected for the exercise in FIG. 3C involves a combination of the wrist in a semi-supine position relative to the forearm, with the elbow flexed and the shoulder moving through flexion, upward and toward the head.

Figure 3B:
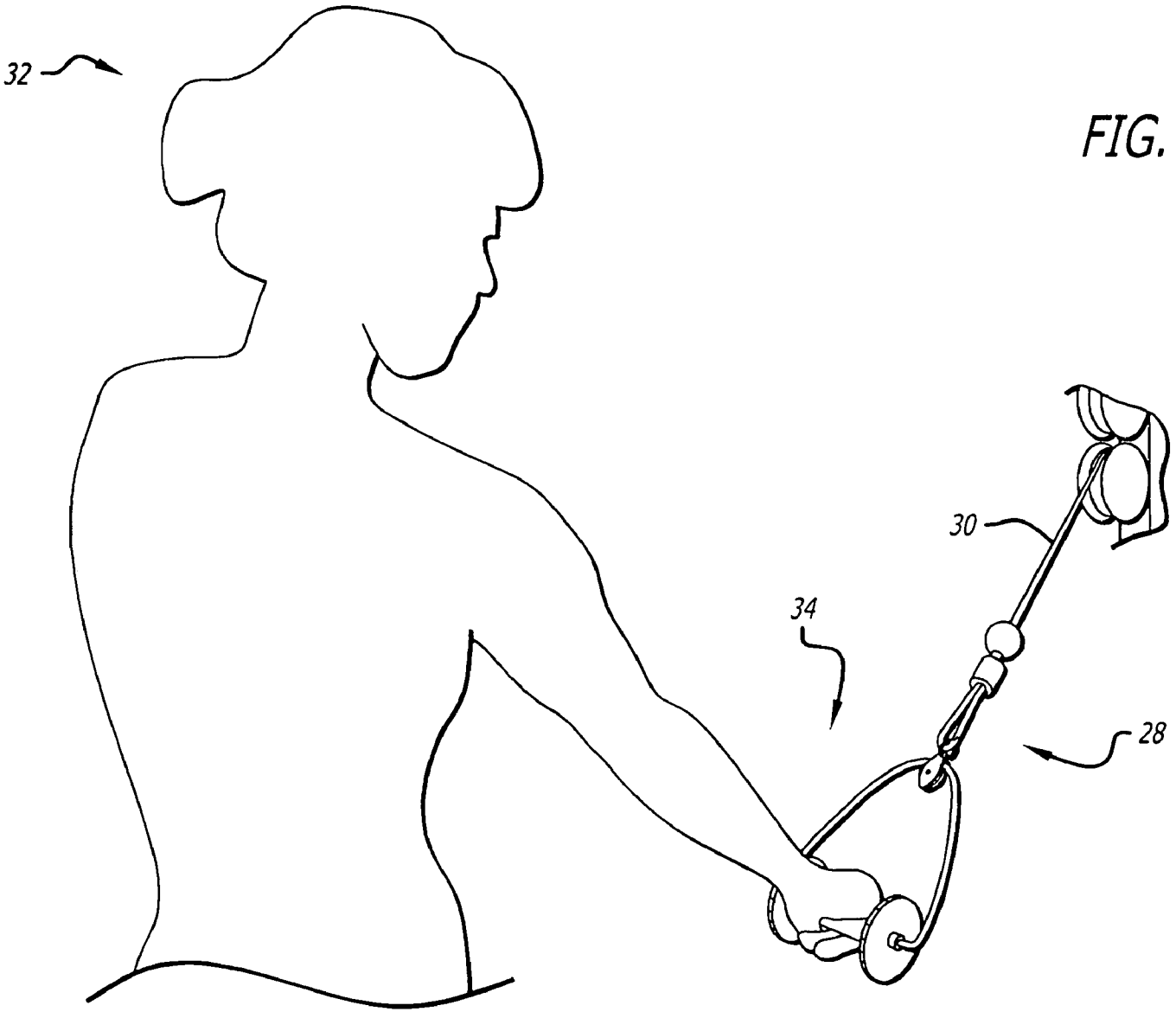
Figure 3C:
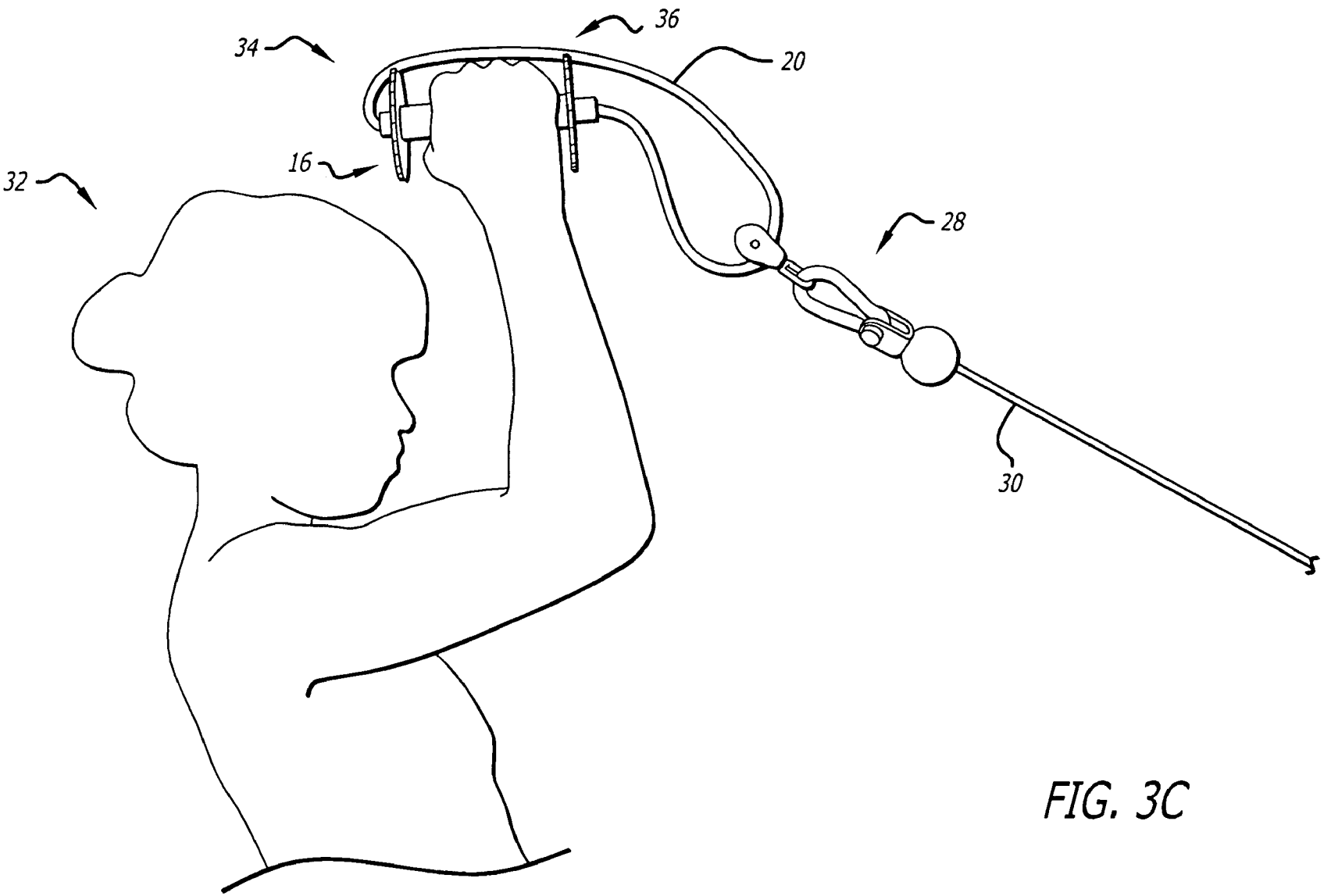

It should be noted that the grip-handle 10 orientations of FIGS. 3A and 3B are identical to, and thereby permit the same exercise as, those offered by a conventional rigid handle that features an integral structure. In contrast, the orientation of the grip-handle 10 of the invention as in FIG. 3C mimics that of a rope-type handle. Thus the grip-handle of the invention permits the user 32 to achieve numerous exercise configurations, and thereby achieve a corresponding variety of workout benefits, with a single device and without incurring the difficulties that accompany the continual changing that characterizes handles in accordance with the prior art.

It may be further noted in reference to FIG. 3C that the side member 16 provides a structure for lifting the flexion cable 20 above the flexed hand 36 of the user 32 when the handle is employed in the manner of a rope. As noted previously, pluralities of notches 16', 18' are arranged about the peripheries of the side members 16 and 18 respectively. As can be appreciated from FIG. 3C, such notches provide regions for effectively locking the position of the flexion cable 20 with respect to the hand hold 12 and, of course, with respect to the flexed hand 36 of the user 32. They thereby prevent the cable 20 from sliding over the circular peripheries of the side members that would otherwise cause the flexion cable 20 to flip, thereby limiting the usefulness of the grip-handle 10 as a rope-like device.

While the hand hold 12 is fixed with respect to the side members 16, 18, the operation of the grip-handle 10 of the invention is facilitated and enabled by the fact that its rigid portion, comprising the hand hold 12 and side members 16, 18, is fully movable with respect to the point of attachment of the pulley guide 24 to the clip 28 that is fixed to the end of the resistance cable 30. This feature of the invention allows a user to grasp the hand hold 12 and place the wrist, without interruption, limitation or change to an alternative grip-handle, through its full range of possible motion, including wrist flexion, extension, radial deviation, ulnar deviation, circumduction, and any wrist movements associated with forearm supination or pronation.

As discussed earlier, the pulley guide 24 permits planar rotation of the grip-handle 10 to thereby adjust the distances between each of the opposed ends of the hand hold 12 and point of attachment of the rotatable hook 26 to the clip 28. Rotation of the cylindrical hand hold 12 about its axis of symmetry during use is also provided. FIG. 2 is a side sectional view of the grip-handle 10 taken at section line 2-2 of FIG. 1. As can be seen, the side members 16, 18 are fixed to the hand hold 12 by means of pairs of screws 38, 40 and 42, 44 respectively. It will be appreciated that other means may be employed for securing the combination of hand hold 12 and side members 16, 18 as an integral unit. In the event that the elements are of metallic composition, they may be molded as a single piece or soldered to one another. Should they be formed of plastic material, they may be molded as a single unit or secured to one another by means of screws or glue.

As can be seen, each of the side members 16 and 18 includes a central aperture 16", 18" whose diameter exceeds that of the elongated cylindrical shaft 22. Accordingly, the hand hold 12 and side members 16, 18 are rotatable as a unit about the elongated shaft 22.

The opposed ends of the flexion cable 20 are received within chambers 46, 48 located at the opposed hollowed ends of the shaft 22. Such ends of the flexion cable 20 are secured to the shaft be means of pairs of set screws 50, 52 and 54, 56. It is thereby seen that the grip-handle 10 of the invention permits the rotation that is required to allow a user to perform and complete exercise movements (opposed by the resistance offered by an exercise platform) without the complication of resistant torquing of the hand hold 12. (The lengths of the set screws 50 through 56 exceed the radial distance between the walls of the chambers 46, 48 and the outer surface of the shaft 22. As a consequence, the set screws 50 through 56 act as stops preventing slippage of the rotatable hand hold 12 from the shaft 22.)

Thus it is seen that the present invention provides a grip-handle that permits a user to perform an increased range of movements against the resistance provided by an exercise platform of the type that includes a cable system for transmitting such resistance force. By utilizing a grip-handle in accordance with the invention, one may obtain an enhanced range of exercise benefits unhindered by grip unsuitability. As a consequence, the user is able to concentrate on muscular development without having to deal with the distractions and delays associated with constant searching for the appropriate grip.

While the invention has been described with reference to its presently-preferred embodiment, it is not limited thereto. Rather, it is limited only insofar as it is defined by the following set of patent claims and includes within its scope all equivalents thereof.

What is claimed is:

1. A grip-handle for exercise equipment of the type that provides a resistance force comprising, in combination:

a) a generally-cylindrical hand hold having opposed ends;

b) side members being fixed to said opposed ends of said hand hold, said side members being substantially-planar and oriented substantially orthogonal to an axis of symmetry of the substantially-cylindrical hand hold, having a dimension that exceeds the diameter of said substantially-cylindrical hand hold;

c) a flexion cable having opposed ends;

d) said opposed ends of said flexion cable being coupled to respective ends of said hand hold;

e) a pulley guide member;

f) said pulley guide member being located intermediate said ends of said flexion cable; and g) a hook being fixed to said pulley guide member for coupling said grip-handle to said resistance cable.

2. A grip-handle as defined in claim 1 wherein said side member includes at least one notch arranged to engage said flexion cable.

3. A grip-handle as defined in claim 2 further characterized in that:

a) said side member has a generally-circular periphery; and b) the diameter of said side member exceeds the diameter of said substantially-cylindrical hand hold.

4. A grip-handle as defined in claim 3 wherein said periphery of said side member has a plurality notches.

5. A grip-handle as defined in claim 1 further including:

a) an elongated shaft;

b) said hand hold being hollow, encircling and coaxial with said shaft; and c) said shaft extending beyond each of said side members.

6. A grip-handle as defined in claim 5 wherein said opposed ends of said flexion cable are fixed to respective ends of said shaft.

7. A grip-handle as defined in claim 6 further including:

a) said opposed ends of said shaft having internal channels for receiving said opposed ends of said flexion cable; and b) at least one set screw for fixing each end of said flexion cable to a respective end of said shaft.

8. A grip-handle as defined in claim 7 further characterized by a spacing between said at least one set screw and a respective side member whereby said side member and grip are rotatable with respect to said shaft and cable.

9. A grip-handle as defined in claim 1 wherein said flexion cable further includes:

a) a core of braided metallic fibers; and b) a cover of flexible material having a smooth exterior surface.

10. A grip-handle as defined in claim 9 wherein said cover is of elastomeric material.

11. A grip-handle as defined in claim 9 wherein said cover is of plastic composition.

12. A grip-handle for exercise equipment of the type that includes a resistance force comprising, in combination:

a) an elongated central shaft having opposed ends;

b) a generally-cylindrical hand hold;

c) said generally-cylindrical hand hold surrounding and being coaxial with said shaft;

d) a flexion cable having opposed ends;

e) said opposed ends of said flexion cable being fixed to respective ends of said shaft;

f) a pulley guide member;

g) said pulley guide member being located intermediate said ends of said flexion cable; and h) a hook being fixed to said pulley guide member for engaging said resistance force.

13. A grip-handle as defined in claim 12 further including:

a) said hand hold having opposed ends; and b) side members fixed to said opposed ends of said hand hold.

14. A grip-handle as defined in claim 13 further including:

a) at least one side member being substantially-planar; and b) said side member having a dimension that exceeds the diameter of said substantially-cylindrical hand hold.

15. A grip-handle as defined in claim 14 further characterized in that:

a) said side member has a generally-circular periphery; and b) the diameter of said side member exceeds the diameter of said substantially-cylindrical hand hold.

16. A grip-handle as defined in claim 15 wherein said periphery of said side member has a plurality notches.

17. A grip-handle as defined in claim 13 further including:

a) said shaft extending beyond each of said side members; and b) said opposed ends of said flexion cable are fixed to respective ends of said shaft.

18. A grip-handle as defined in claim 17 further including:

a) said opposed ends of said shaft having internal channels for receiving said opposed ends of said flexion cable; and b) at least one set screw for fixing each end of said flexion cable to a respective end of said shaft.

19. A grip-handle as defined in claim 18 further characterized by a spacing between said at least one set screw and a respective side member whereby said side member and hand hold are rotatable with respect to said shaft and cable.

20. A grip-handle as defined in claim 12 wherein said flexion cable further includes:

a) a core of braided metallic fibers; and b) a cover of flexible material having a smooth exterior surface.

* * * * *